US005226476A

United States Patent [19]

Martin

[11] Patent Number: 5,226,476

[45] Date of Patent: Jul. 13, 1993

[54] HEAT EXCHANGER WITH BENT INLET AND OUTLET TUBE BRANCHES, AND A METHOD OF MAKING SUCH BRANCHES

[75] Inventor: Daniel Martin, Pantin, France

[73] Assignee: Valeo Thermique Moteur, Le Mesnil-Saint-Denis, France

[21] Appl. No.: 917,595

[22] Filed: Jul. 23, 1992

[30] Foreign Application Priority Data

Jul. 26, 1991 [FR] France ..... 91 09532

[51] Int. Cl.[5] ..... F28F 7/00

[52] U.S. Cl. ..... 165/157; 165/178; 165/916; 285/179; 72/369

[58] Field of Search ..... 165/157, 178, 916; 138/177, DIG. 8; 285/179, 183; 72/369

[56] References Cited

U.S. PATENT DOCUMENTS

| | | | |
|---|---|---|---|
| 1,777,120 | 9/1930 | Lewin | 285/179 X |
| 3,362,061 | 1/1968 | Krasnitz | 72/369 X |
| 4,527,411 | 7/1985 | Shirosaki et al. | 72/340 |
| 4,768,580 | 9/1988 | Ferguson | 165/41 |
| 5,124,225 | 10/1992 | Armbruster et al. | 165/51 |

FOREIGN PATENT DOCUMENTS

| | | | |
|---|---|---|---|
| 0273462 | 7/1988 | European Pat. Off. . | |
| 2189142 | 1/1974 | France . | |
| 59-215909 | 12/1984 | Japan | 165/916 |
| 62-5092 | 1/1987 | Japan | 165/916 |
| 1434651 | 5/1976 | United Kingdom . | |

*Primary Examiner*—Allen J. Flanigan
*Attorney, Agent, or Firm*—Morgan & Finnegan

[57] ABSTRACT

An oil/water heat exchanger for a motor vehicle has an inlet tube branch and an outlet tube branch joined to the body of the heat exchanger. Each of these tube branches has a bent portion close to the heat exchanger body. The transverse cross section of the bent portion is flattened (elongated), with its minor dimension extending in the direction of the radius of curvature of the longitudinal axis of the tube branch. This enables this radius, and therefore also the amount by which the tube branches project from the tube body, to be reduced for a given fluid passage cross sectional area.

5 Claims, 1 Drawing Sheet

HEAT EXCHANGER WITH BENT INLET AND OUTLET TUBE BRANCHES, AND A METHOD OF MAKING SUCH BRANCHES

FIELD OF THE INVENTION

This invention relates to heat exchangers having an inlet tube branch and an outlet tube branch for a first fluid such as a fluid to be cooled, the tube branches being joined to a body or casing of the heat exchanger in which the first fluid is in heat transfer relationship with a second fluid. The invention is especially applicable to heat exchangers for cooling engine oil in a motor vehicle, and more particularly to oil/water heat exchangers arranged between the engine oil filter and the engine block of the vehicle.

BACKGROUND OF THE INVENTION

In this type of heat exchanger, the inlet and outlet tube branches are generally joined to the heat exchanger body at one face of the latter. The space available outside and adjacent to this face is limited, so that the tube branches need to be bent immediately adjacent to that face of the body, so as then to extend away from the body in a direction substantially parallel to the face to which they are joined.

The minimum radius of curvature that can be given to a tube of circular transverse cross section without either rupture or dangerous deformation occurring, is an increasing function of its diameter.

The minimum size of the tube branches in the direction at right angles to the associated face of the body is thus determined by the diameter of the tube branches, and therefore by their fluid passage cross sectional area.

DISCUSSION OF THE INVENTION

An object of the present invention is to reduce the above-mentioned size to a minimal value for any given fluid passage cross sectional area.

According to the invention, in a heat exchanger comprising a hollow body for effecting heat transfer between a first fluid and a second fluid, a first tube branch, and a second tube branch, the tube branches being carried by the body for entry into the body and exit therefrom, respectively, of the said first fluid, each said tube branch defines an axis thereof and has a bent portion defining a radius of curvature of the said axis, the bent portion having a transverse cross section which is flattened so as to define a minor dimension in the direction of the said radius of curvature.

The minimum radius of curvature is thus that which corresponds to a tube diameter equal to the dimension of the bent portion in the direction of the radius of curvature, while the area of the passage cross section is greater than that corresponding to that diameter.

The invention is applicable in particular where the longitudinal axes of the tubes extend, in the vicinity of their junction to the body of the heat exchanger, substantially at right angles to a wall of the body to which they are fixed, for example by welding or brazing.

The tube branches may have an elongated (flattened) cross section over their whole length. However, in order to facilitate fixing of their free ends to flexible inlet and outlet pipes, they preferably include an outer terminal portion, beyond the bent portion, having a substantially circular cross section.

One method according to the invention, for making a tube branch that includes such a portion with a circular transverse cross section comprises the steps of: taking a tube having a substantially circular transverse cross section; flattening the said tube over part of its length so as to produce an elongated and flattened cross section; and bending the flattened portion through a radius of curvature extending in the same direction as the minor dimension of its flattened cross section, so as to form the bent portion of the tube branch.

An alternative method according to the invention comprises the steps of: taking a tube having a flattened cross section; bending the tube over part of its length through a radius of curvature extending in the same direction as the minor dimension of its flattened cross section so as to form the bent portion of the tube branch; and re-forming the remainder of the tube to a substantially circular cross section so as to form the outer terminal portion.

The particular means used for deforming the tube are known per se and are not part of this invention. In order to give the tube either a flattened or a circular cross section, as required, a mandrel of appropriate cross section may in particular be employed. In order to prevent squashing of the tube when bending the appropriate portion thereof when this is already of flattened cross section, it may be filled with a granular material such as sand, or with a deformable material such as rubber.

Further features and advantages of the invention will appear more clearly from the detailed description of a preferred embodiment of the invention that follows, given by way of example only and with reference to the accompanying drawings.

DESCRIPTION OF A PREFERRED EMBODIMENT OF THE INVENTION

The drawings show an oil/water heat exchanger 1 which is basically of a known type for fitting between the oil filter and the engine block of a motor vehicle. The heat exchanger 1 comprises a body or casing 2 and two aluminium tube branches 3 for entry and exit of the oil. The internal structure of the casing 2 and the operation of the heat exchanger are not part of the present invention and need not be described here.

Figure 1:
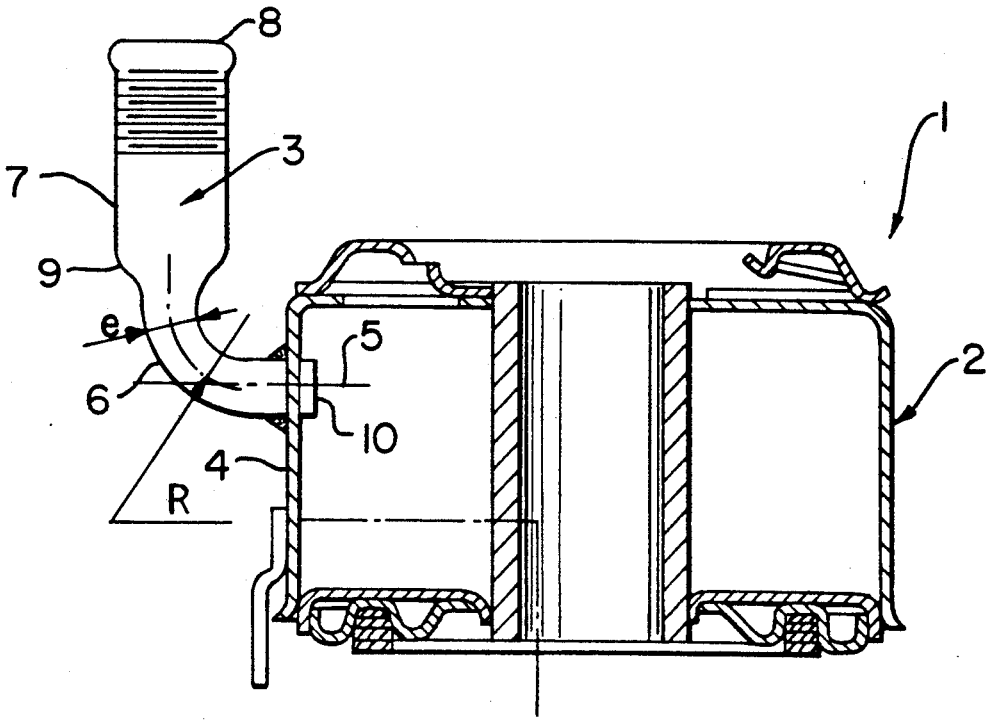
FIG. 1 is a view of an oil/water heat exchanger in accordance with the invention, in cross section taken on the line I—I in FIG. 2.

The tube branches 3 pass through a flat sheet metal outer wall 4 of the casing 2, to which they are brazed. Each tube branch 3 defines an axis 5 intersecting the wall 4 and following, outwardly from the latter as shown in FIG. 1, a curved shape in which the axis 5 is bent through about a quarter of a circle of radius R, in a portion 6 of each tube branch 3 which joins the end 10 of the branch that is brazed to the wall 4 to a straight portion 7 of the branch terminating in the free end 8 of the latter. The inner end 10 of each branch lies inside the casing 2.

Figure 2:
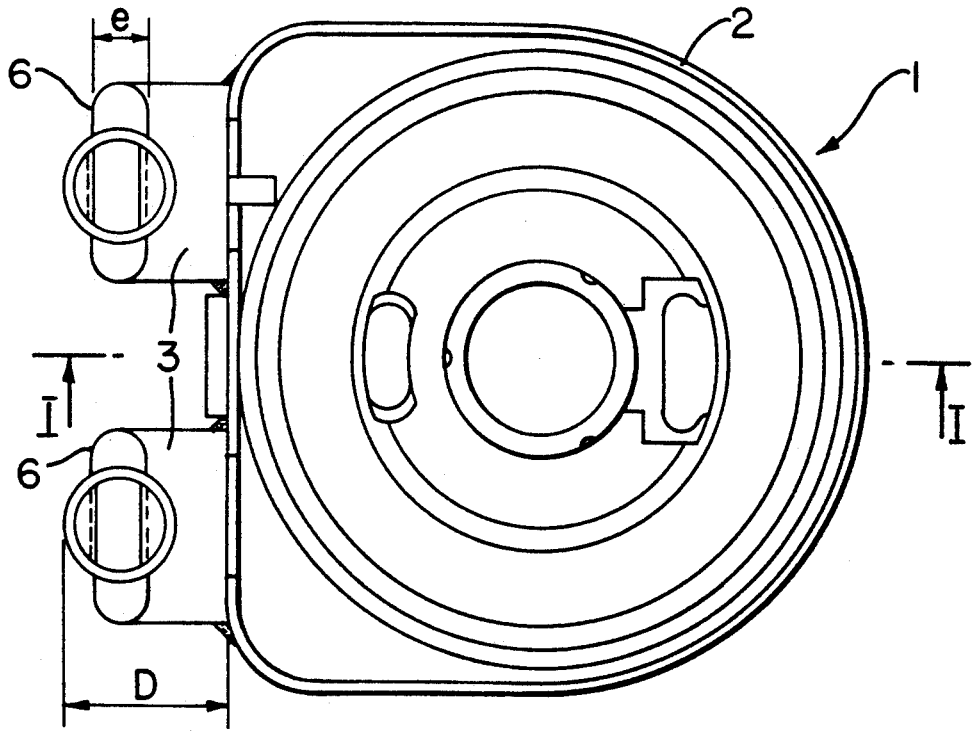
FIG. 2 is a top plan view of the same heat exchanger.

The bent portion 6 of each tube branch 3 has an elongated or flattened transverse cross section as seen in FIG. 2. This cross section characterises the branch from its inner end 10 to a transition zone 9 which is part of the straight terminal portion 7 of the tube branch. The minor dimension e of the flattened cross section extends in the same direction as the plane containing the axis 5 and the radius of curvature R of the bent portion 6. Its major dimension is therefore, in this example, parallel to the wall 4. The straight terminal portion 7 comprises the transition zone 9 joining the curved portion 6 to the main part of the portion 7, which has a circular cross section for receiving a flexible pipe.

Each tube branch 3 projects from the flat wall 4 by an overall distance D (FIG. 2). This distance D is smaller than it would have been if the cross section of the tube branches had been circular over their whole length, with the same surface area as that of the portions having the flattened cross section shown in the drawings and described above. This accordingly reduces the overall size of the heat exchanger in the direction at right angles to the wall 4.

Each tube branch 3 can be made by either one of two methods. In the first of these, a tube of substantially circular transverse cross section is flattened over part of its length, and the flattened portion is then bent through a radius of curvature extending in the same direction as the minor dimension of its flattened cross section, so as to form the bent portion of the tube branch. In the second method, a tube having a flattened cross section is first bent through a radius of curvature extending in the same direction as the minor dimension of its flattened cross section so as to form the bent portion of the tube branch. The remainder of the tube is then re-formed to a substantially circular cross section so as to form the outer terminal portion 7.

What is claimed is:

1. A heat exchanger comprising a hollow body for effecting heat transfer between a first fluid and a second fluid, a first tube branch, and a second tube branch, the tube branches being carried by the body for entry into the body and exit therefrom, respectively, of the said first fluid, wherein each said tube branch defines an axis thereof and has a bent portion defining a radius of curvature of the said axis, the bent portion having a transverse cross section which is flattened so as to define a minor dimension in the direction of the said radius of curvature.

2. A heat exchanger according to claim 1, wherein the body has a wall to which the tube branches are secured, each said axis being substantially perpendicular to the said wall in the vicinity of the latter.

3. A heat exchanger according to claim 1, wherein each tube branch further includes an outer terminal portion of substantially circular cross section, joined to the bent portion at the end of the latter remote from the body of the heat exchanger.

4. A heat exchanger according to claim 3, wherein the body has a wall to which the tube branches are secured, each said axis being substantially perpendicular to the said wall in the vicinity of the latter, the said axis being substantially parallel to the said wall in the outer terminal portion.

5. A heat exchanger according to claim 1, adapted for the said fluids to be oil and water.

* * * * *